US005514272A

United States Patent [19]

Santos

[11] Patent Number: 5,514,272

[45] Date of Patent: May 7, 1996

[54] PROCESS FOR RE-REFINING USED OIL

[76] Inventor: Benjamin S. Santos, 38735 Huntington Cir., Fremont, Calif. 94536

[21] Appl. No.: 71,775

[22] Filed: Jun. 4, 1993

Related U.S. Application Data

[63] Continuation-in-part of Ser. No. 879,634, May 7, 1992, abandoned.

[51] Int. Cl.[6] ..... C10M 175/02

[52] U.S. Cl. ..... 208/179; 208/181; 208/251 R

[58] Field of Search ..... 208/179, 181, 208/251 R

[56] References Cited

U.S. PATENT DOCUMENTS

| | | | |
|---|---|---|---|
| 3,923,643 | 12/1975 | Lewis et al. | 208/179 |
| 3,971,713 | 7/1976 | Ellender, Jr. | 208/226 |
| 3,990,963 | 11/1976 | Audibert et al. | 208/179 |
| 4,029,569 | 6/1977 | Ivey, Jr. | 208/181 |
| 4,238,241 | 12/1980 | Schneider | 106/281 |
| 4,502,948 | 3/1985 | Tabler | 208/181 |
| 4,559,128 | 12/1985 | Goodrich | 208/22 |
| 5,049,256 | 9/1991 | Luce | 208/13 |

OTHER PUBLICATIONS

Kirk–Othmer, "Asphalt" Encyclopedia of Chemical Technology, Third Edition, vol. 3, Antibiotics (Phenazines) to Bleaching Agents, pp. 299–382 (no date).

Interline Resources Corporation, "Interline Re–refining Process", Executive Summary, Oct. 1993.

M. L. Whisman, J. W. Goetzinger, and F. O. Cotton, "Petroleum Refinery Engineering", Report of Investigations 7884, Waste Lubricating Oil Research, p. 228, 1974.

W. L. Nelson, "Chemical Treatments", Petroleum Refinery Engineering, Fourth Edition, pp. 261/292–297, 1958.

English Translation of Patenschrift, DE 42 05 885 C1, for Bernard Meinken, Mar. 1993.

English Translation of Offenlegungsschrift, DE 42 05 884 A1, for Bernard Meinken, Sep. 1993.

N. J. Weinstein, "Disposal of Recovery Process Residues" Waste Oil Recycling and Disposal, Aug. 1974, p. 170.

"Waste Oil" Texy by Mueller Associates Inc. (1989).

*Waste Lubricating Oil research, Report of Investigations,* U.S. Dept of the Interior Rogers CB Morton Secretary, Bureau of Mines John D. Morgan, Jr. Act Director, 1974.

*Petroleum Refinery Engineering, 4th Ed.* McGraw Hill 1958. W. L. Nelson pp. 217, 228.

*Primary Examiner*—E. Rollins Cross
*Assistant Examiner*—Walter D. Griffin
*Attorney, Agent, or Firm*—Ronald Fish; Falk, Vestal & Fish

[57] ABSTRACT

A process for significantly decreasing the acid sludge settling time in waste oil recovery processes comprising the steps of heating used oil to a high temperature above 700 degrees Fahrenheit, cooling the heated oil, adding an oxidizing agent to the oil, allowing the acid sludge to settle within a period of approximately 24 to 72 hours, separating the acid-sludge-free oil from the acid sludge which settles out of solution as a result of addition of the oxidizing agent, and adding a polishing agent and separating the re-refined oil from the spent polishing agent. The process produces a high quality re-refined oil rapidly and economically.

20 Claims, 2 Drawing Sheets

PROCESS FOR RE-REFINING USED OIL

This is a continuation-in-part of a U.S. patent application entitled "An Improved Process for Re-refining Used Oil", Ser. No. 07/879,634, filed May 7, 1992, now abandoned.

BACKGROUND OF THE INVENTION

1. Field of the Invention

The present invention pertains to re-refining used oil and in particular, to a process for significantly decreasing acid sludge settling times in used oil refining processes.

2. Description of the Prior Art

Because of the huge volume of used oil from vehicle engines and the oil shortage, an oil recycling industry has grown up. Prior art processes for re-refining used mineral lubricating oil include the acid-clay method, extraction acid-clay method, distillation-clay method, distillation-hydrotreating method, and the distillation method. The acid-clay method is the most widely used method.

The current processes used to recover used oil involve heating the used oil to a temperature in the range of 212°–720° F., cooling the heated oil, adding acid to oxidize and remove the carbonaceous impurities, metal components and other oxidized materials, and then waiting a substantial period, generally two days or more for the acid sludge to settle.

During the lengthy interval in which the acid sludge settles, the acid, which had been added to the oil during the cooling step, is still present and in contact with the oil. Typically the acid is sulfuric acid. The lengthy contact with the sulfuric acid causes the oil to become dark brown and "burnt" or "charred" in color. The longer the oil is in contact with the acid, the darker the oil becomes. In addition, prolonged contact of the acid with the oil causes the resulting re-refined oil to be very acidic. An acidic oil is corrosive and cannot be used.

These prior art oil re-refining processes are very time consuming because of the extensive amount of time required to achieve complete settling of the acid sludge. As a result, oil recovery using these processes is not economical. In addition, these processes have had very limited success in producing quality lubricating oil. To achieve a high quality re-refined lubricating oil, all acid sludge must be removed from the oil and the color must be lightened for most consumers of such oil. However, high quality lubricating oils are difficult to produce through re-refining processes, because even after weeks or months have elapsed, the acid sludge does not settle, or has incompletely settled. Consequently, impurities remain suspended in the oil and the resulting oil is of low quality. Therefore, complete and rapid settling of the acid sludge is essential to achieving high quality, low cost, re-refined lubricating oil.

Failure of the prior art to develop a used oil re-refining process in which the acid sludge settles rapidly has also been aggravated by the cars which are currently being manufactured. The cars of today have smaller and more lightweight engines. These smaller engines get hotter than the larger engines of the past. This additional heat causes the oil to break down faster thereby producing carbon and carbonaceous impurities to build-up in the oil. Therefore oil companies are increasingly placing more additives, such as dispersant, detergent, viscosity improving compounds, or antisludge compounds, etc. into the oil. Over the years it has been shown that these additives have caused a gradual increase in the acid sludge settling time. Therefore, the problem of long settling times in prior art re-refining processes has grown even greater.

Thus, there has arisen a more urgent need to develop a process for recovering waste oil rapidly and economically by decreasing the acid sludge settling time.

SUMMARY

The present invention is a process for decreasing the acid sludge settling time in waste oil recovery processes. The present process comprises the steps of heating used oil to a temperature above 725 degrees Fahrenheit, cooling the heated oil, adding sulfuric acid to the oil to oxidize the oxidizable components in the oil, allowing the acid sludge resulting from the addition of the sulfuric acid to settle over an interval of from one to three days, separating the acid-sludge-free oil from the acid sludge, adding a polishing agent to the acid-sludge-free oil, and separating the resulting color-lightened, re-refined oil from the spent polishing agent.

In alternative embodiments, steam sparging, i.e., bubbling of steam through the oil while it is being heated is performed with the oil either at atmospheric pressure or with vacuum applied thereto. In some alternative embodiments, inert gas is pumped into the vessel containing the oil to fill the space above the oil to minimize the possibility of explosion of any light ends which have outgassed from the heated oil. In most embodiments of the process, agitation is performed after the oxidizing agent has been added to insure thorough mixing of the oxidizing agent.

In particular, the high temperatures used in the process of the present invention in conjunction with the other steps of the process both decreases the settling time for the acid sludge to settle thereby reducing the exposure of the oil to the oxidizing agent, as well as increases the degree to which the acid sludge settles thereby increasing the yield over prior art acid-clay re-refining processes from about 50% up to about 75%, and increases the quality of the recovered oil by lightening its color to about 2.5 on the ASTM scale. In addition, the decrease in settling time decreases manufacturing costs thereby enabling the economical production of a re-refined oil.

DETAILED DESCRIPTION

Figure 1:
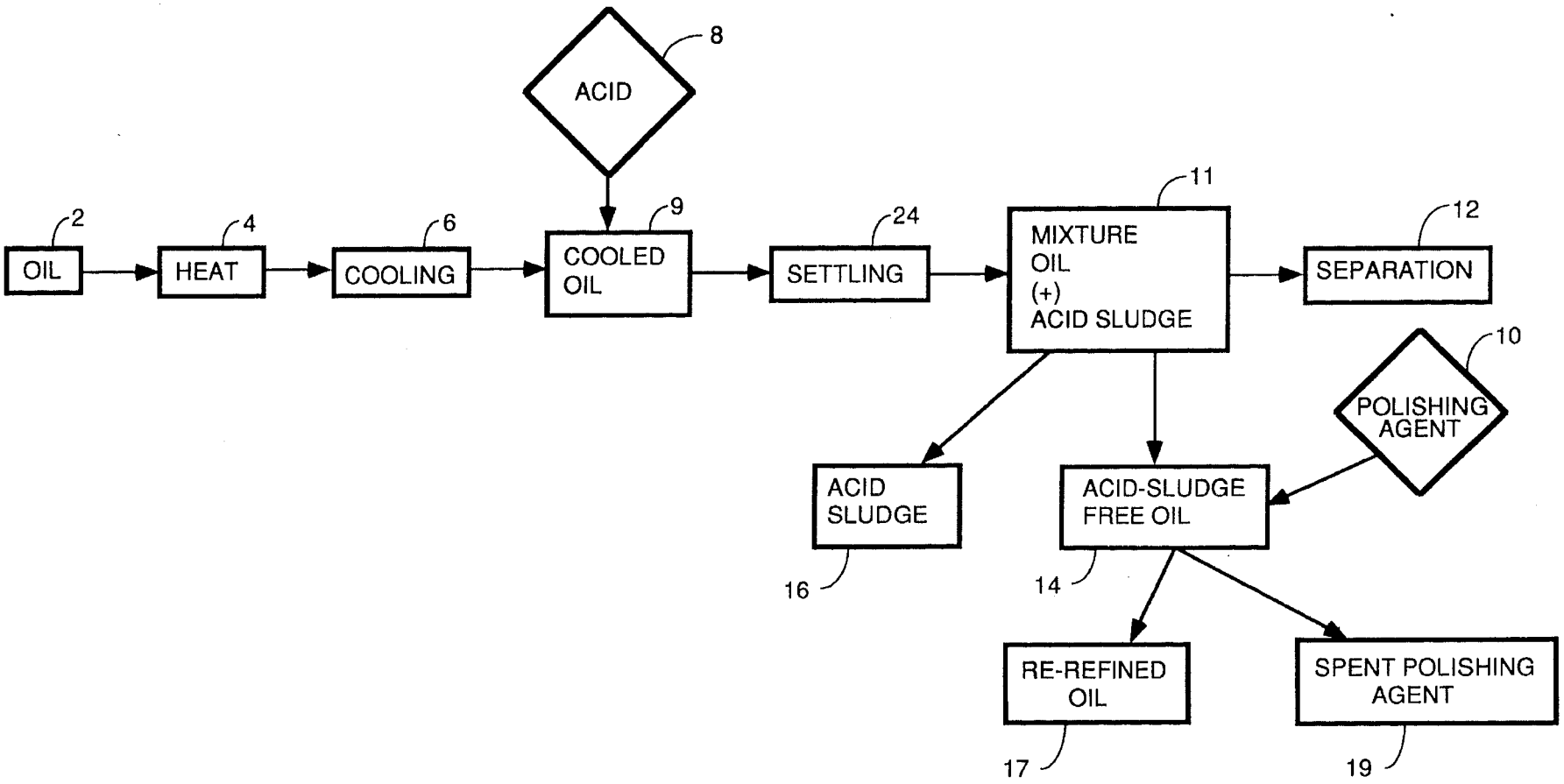
FIG. 1, is a schematic diagram of the re-refining process of the present invention.

Referring to FIG. 1, the present invention is a process for re-refining used oil. The process will decrease the acid sludge settling time which will enable the rapid and economical refining of used oil into a very high quality re-refined oil. The process of the present invention comprises the steps of:

a) providing used oil (step 2);

b) heating the oil (step 4);

c) cooling the oil (step 6);

d) treating the cooled oil (block 9) with $H_2SO_4$ (step 8) and, optionally, agitating;

e) allowing the resulting acid sludge to settle (step 24) over the space of from one to three days to generate a mixture of relatively pure, acid-sludge-free oil and acid sludge (block 11);

f) separating (step 12) the acid-sludge-free oil (block 14) from the acid sludge (block 16); and g) adding polishing agent (step 10) to the acid-sludge-free oil and separating the re-refined oil from the acid sludge resulting in a rapidly-produced, high-quality re-refined oil (block 17) and spent polishing agent (block 19).

The process according to the teachings of the invention drastically decreases the acid sludge settling time, increases total yield from typical yields of around 50% in the prior art to approximately 75% in the process according to the teachings of the invention, and increases the quality of the recovered oil by lightening its color.

The process in more detail is as follows. The starting material is used lubricating oil (step 2). Generally, this used oil is gathered from any used oil source such as auto repair shops, industrial plants, etc. Typically, the used oil is used mineral lubricating oil of automotive or industrial grade and the like. These used mineral lubricating oils contain a variety of components including carbonaceous impurities, metal components, other oxidizable materials, water, additives and alcohols.

Heat (step 4), is applied to the oil to drive off water, additives and volatile components and to enable rapid acid sludge settling. It is believed that the high temperatures of the process according to the teachings of the invention drive off the additives which slow down or prevent settling of acid sludge in prior art re-refining processes. Heat can be applied to the oil according to a variety of different processes. Some of these processes include, dehydration, fractionation, distillation and extraction. These processes are well known in the art.

In general, the oil is heated to temperatures in the range of from greater than 725° F. to 1000° F., preferably 725°–850° F. although the range from greater than 725° F. to 750° F. is also used. Typically, oil re-refining processes of the prior art heat oil to temperatures in the range of from 212°–550° F. and teach avoidance of temperatures above the cracking temperature at around 680° F. to avoid thermal breakdown of the long hydrocarbon chain molecules essential to good lubricating qualities. That is, prior art processes rarely require temperatures above 550° F. because of the adverse effects such temperatures have on the yield and the equipment used. Because of the nature of the oil molecules, high temperatures will cause degradation of the oil by cracking. Cracking is defined as larger hydrocarbon chains breaking down into smaller chained compounds. In other words, a long chain hydrocarbon, i.e., a hydrocarbon having a number of carbon atoms, will break up into smaller chain hydrocarbons. Another term for these small chain hydrocarbons is "light ends". Thus, the cracking process which occurs at high temperatures causes light ends to form. These light ends are more volatile than the original oil and can lead to explosions or fires and personal injury or damage to the re-refining equipment.

Although cracking occurs to some extent at the prior art temperatures of 212°–550° F., the extent of cracking is generally expected to increase significantly as the temperature of the oil is increased. For example, at temperatures above 550° F., the extent of cracking is expected to be so great as to make the process undesirable, both economically and in terms of the end product.

Another reason prior art processes do not require temperatures above 550° F. pertains to the equipment used in oil re-refining processes. The equipment used in prior art re-refining processes is not designed to function continuously at temperatures above 600° F. If such equipment is exposed to such high temperatures for long periods of time, it will break down. Since the equipment is very costly to replace, there is little motivation to intentionally operate at such extreme temperatures. Therefore, there was perceived in the prior art little or no advantage in raising temperatures above 600° F. and, in fact, workers in the art were advised not to exceed the cracking temperature because of these adverse effects.

In contrast to the prior art, one of the unexpected results of the present process is the lack of a significant decrease in yield when the oil is heated to temperatures above 600° F. In fact, although temperatures well above the traditional cracking temperatures are used, a significant increase in yield has been experienced. The applicant has discovered that, although there is some cracking when the oil is heated to temperatures at or above 725° F., the extent of cracking is not appreciably greater than that which occurs at 212°– 550° F. (the process temperatures of the prior art) for reasons which are not completely understood.

Another advantage to heating the oil to temperatures in excess of 725° F., is a significant decrease in acid sludge settling time. The phrase "settling time" refers to the time it takes to achieve complete settling of the acid sludge in the recovery vessel. The degree of settling determines the quality of the oil. For example, the more complete the settling, the higher the quality of the oil. When complete settling is achieved, the purified oil can be removed and processed further to an oil of near virgin quality.

In the process according to the teachings of the invention, the time for complete settling is in the range of from one to three days. Therefore, the entire recovery process of the present invention is completed within a very short period of from one to three days which is substantially shorter than the typical prior art settling time of two or more weeks. Further, in the prior art processes even though settling times of weeks were experienced, complete settling never actually occurred.

In the process according to the teachings of the invention, the oil is heated to a temperature sufficient to achieve complete acid sludge settling when the cooled oil is mixed with an oxidizing agent. Typically the oil is heated until it reaches a temperature in the range of above 725° to 1000° F. and preferably to a temperature between a temperature above 725° F. and 750° F.

To heat 1000 gallons of used lubricating oil to a temperature in the range of from 726°–750° F. takes somewhere between a fraction of an hour to several hours. The amount of heating time can be decreased in a number of ways, for example, by increasing the heating surface area of heating coils immersed in the used oil, by increasing the BTU heating capacity of the heater, or by decreasing the volume of used lubricating oil to be heated or any combination of these techniques.

In addition, the quality of the used oil will affect the heating time. For example, if the oil contains water or is very viscous, the heating time will be longer. However, the interval during which heat is applied is not critical. Generally the heating interval is dependent upon the flash point of the waste oil being refined. An oil having a high flash point will require a longer heating interval than an oil having a low flash point. However, once the temperature of 726°–850° F. has been reached, there is no need to apply further heat.

The oil is then removed from the heat and allowed to cool (step 6) to approximately room temperature, i.e., from 70° F.–120° F. There are a variety of methods by which the oil is cooled. Heat transfer is one method. During heat transfer, the oil cools by virtue of the heat from the oil transferring to the ambient in which the oil recovery vessel is located through the vessel walls and the surface of the oil. Alternatively, the vessel containing the heated oil is cooled by an active cooling source. For example, the vessel containing the heated oil cools by exposing the vessel to cold water, cold air, or a low boiling point chemical which may be circulated through cooling coils immersed in the oil. It is preferred to use a shell and tube heat exchanger through-which water flows to cool the heated oil.

When the oil has cooled, sulfuric acid (step 8) is added to the oil. The concentration of the sulfuric acid is in the range of from 80–98 wt %. The volume of sulfuric acid added to the cooled oil (step 9) is that volume which is sufficient to generate complete sedimentation of the acid sludge within 72 hours but preferably within 12–24 hours. The quantity of acid and oil utilized in the present process is generally in the range of from 3 to 15% $H_2SO_4$ by volume, and, preferably, between 5–10% $H_2SO_4$ by volume. Excess acid will be wasted and therefore is unnecessary. In addition, excess acid could result in a poor quality refined oil. The sulfuric acid oxidizes carbonaceous materials, metals, and all oxidizable components in the waste oil to create acid sludge. Oxidation of the various impurities facilitates the removal of those impurities in the acid sludge to leave a quantity of acid-sludge-free oil (block 14) and increases the eventual quality of the re-refined oil (step 17).

The concentration of the sulfuric acid affects the color of the resulting re-refined oil produced in the present process. As the concentration of the sulfuric acid increases, the color of the lubricating oil becomes whiter thereby increasing the quality of the lubricating oil. However, if the acid is allowed to remain in contact with the oil for a lengthy period, the oil will become charred and unusable. Therefore, it is desirable to minimize the acid-oil contact interval in order to obtain a re-refined oil that is as white as possible. Generally, the color of the re-refined oil generated in the present process is in the range of from 2.0–5.0 and preferably 2.0–3.0 according to the color scale of ASTM (American Society for Testing and Materials) Method D1500. This method is well-known by those skilled in the art.

This mixture of acid and impurities is termed "acid sludge." Thus, what had been only oil is now a mixture of oil and acid sludge symbolized by block 11 in FIG. 1. Complete settling is achieved when the acid sludge is approximately 20–30 volume percent of the oil leaving approximately 70–80% of the volume of used oil remaining after heating as acid-sludge-free oil (block 14). After the acid sludge has settled out, the oil and acid sludge are separated as symbolized by step 12 into acid sludge (block 16) and acid-sludge-free oil (block 14). Separation can be achieved using a number of different processes, for example, decanting, suctioning, gravity, centrifuge, etc.

A polishing agent (10) is added to the oil to facilitate removal of particles which color the oil. In addition, the polishing agent deodorizes, decolorizes and deacidifies the oil. The polishing agent should have large pores and large surface area per particle to absorb oxidized particles and those particles which color the oil. The polishing agent can be clay, bleaching earth, activated carbon, bauxite or the like but clay and bleaching earth are preferred. After the polishing agent is spent (block 19), it is separated from the rerefined oil.

The resulting re-refined oil (step 17) is a high quality oil having ASTM color scale in the range of from 2.0–5.0 preferably 2.0– 3.0 and has a viscosity in the range of from 5–20 centistokes when measured at 100° C.

Figure 2:
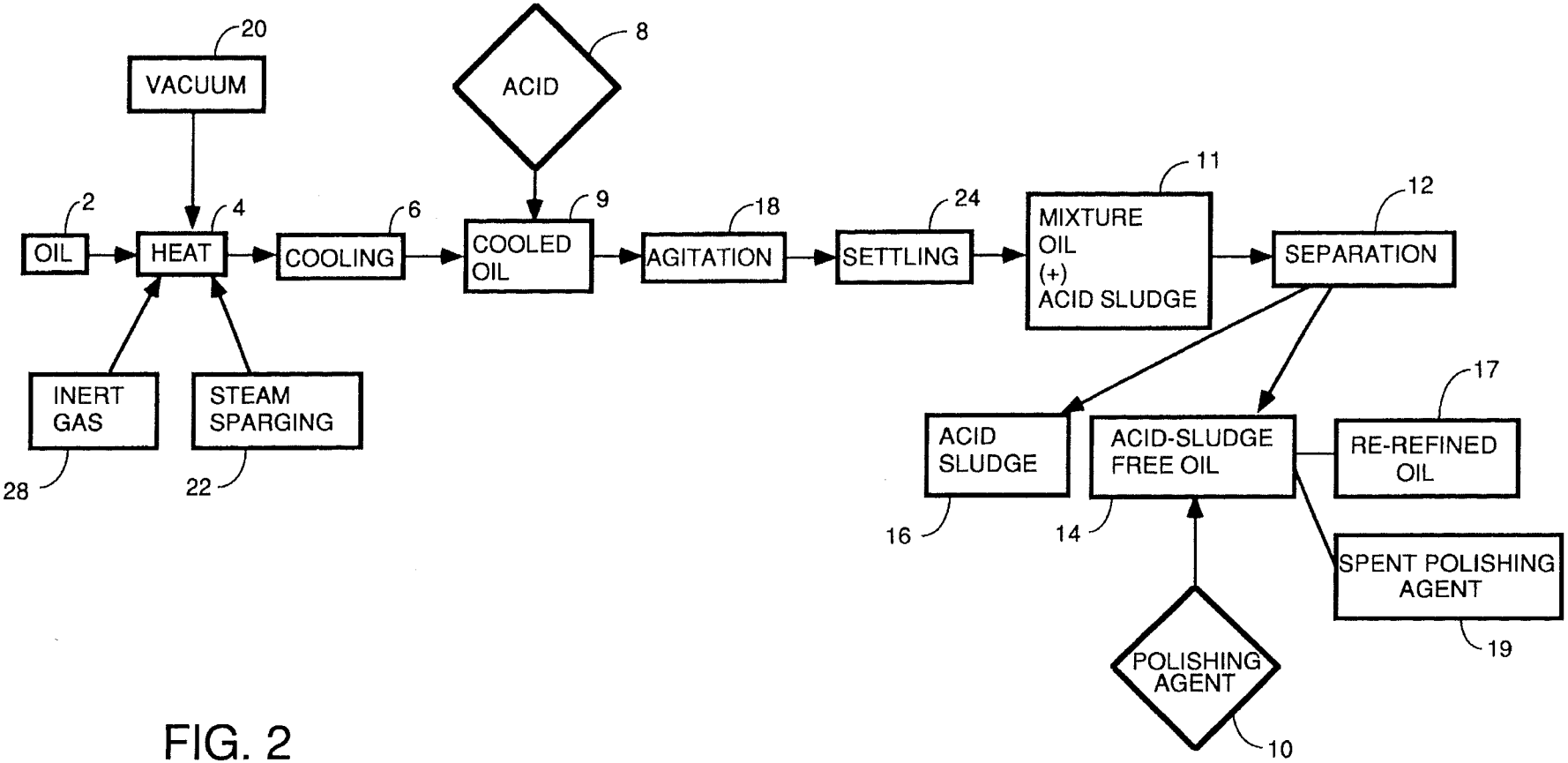
FIG. 2, is a schematic diagram of the re-refining process of the present invention in which vacuum, steam sparging and inert gas are applied, separately or in combination, during the heating step.

FIG. 2 is a process flow diagram showing an alternate embodiment of the present process for re-refining used oil. The process comprises the steps of: heating the oil (step 4); applying vacuum (step 20), sparging with steam (step 22) or inert gas (step 28) or a combination thereof, while heating the oil; cooling the oil (step 6); adding acid to the cooled oil (step 8); agitating the mixture (step 18) and allowing the acid sludge to settle (step 24) to create a mixture of oil and acid sludge (block 11); separating the oil from the acid sludge (step 12) to get acid-sludge-free oil (block 14) and acid sludge (block 16); adding polishing agent (step 10), and separating the spent polishing agent (block 19) from the re-resulting re-refined oil (block 17).

In this preferred embodiment, the cooled oil is agitated (step 18) during or after the acid oxidizing agent is added. Agitation enables a more complete and rapid oxidization of the various oxidizable compounds in the oil. After the oxidizing agent is added and the agitation is complete, the acid sludge is allowed to settle (step 24).

In addition, in this embodiment, vacuum is applied during heating to help remove volatile components. The level of pressure applied to the used oil during the heating process can range from full vacuum to a pressure above atmospheric pressure. The preferred pressure is a vacuum measuring 10–30 inches Hg on a vacuum gauge. The vacuum application (step 20) is applied by using a closed container to hold the used oil with the space in the container above the used oil coupled to a source of vacuum. Application of vacuum (step 20) facilitates removal of the light ends by outgassing. Application of vacuum also functions as a safety mechanism to remove vaporized additives and light ends. When the light ends outgas, they are in the form of an explosive gas. Therefore, removing the light ends through a vacuum source prevents the accumulation of a gaseous ignitable mixture of various light ends in an area where agitation motors, which generate sparks, and heaters, which may use open flames, are operating. The vacuum (step 20) therefore eliminates a potentially explosive situation. These light end byproducts have market value in that they are a potential source of energy. For example, these light ends can be used as fuel for producing power or in heating the next batch of oil to be refined. Alternatively, the light ends may be used to power all or some energy consuming steps of the refining process according to the teachings of the invention.

Steam sparging (step 22) also facilitates the removal of light ends. The phrase "steam sparging" means bubbling steam through the solution. In the present process, steam is bubbled through the oil to increase the rate at which the light ends outgas from the oil. Typically in steam sparging, saturated or super-heated steam is used. The steam also functions to dilute the concentration of light ends as they are expelled. Thus, the gaseous mixture of light ends is leaner and less likely to ignite. Applying a combination of steam sparging (step 22) and vacuum (step 20) increases the rate of removal of light ends.

Alternatively, according to the teachings of the present invention, inert gas (step 28) may be pumped into the closed chamber holding the oil during heating (step 4). The function of the inert gas is similar to that of steam. When inert gas is injected into the hot oil, it forces out the air which is present above the oil surface. Because light ends such as gasoline, gas oil, naphtha, etc. are continuously generated from the hot oil during heating, the use of inert gas greatly reduces the possibility of explosion. Any inert gas may be used. Typically nitrogen and helium work well. However, helium is rather expensive in comparison to nitrogen.

This invention is further illustrated by the following specific but non-limiting examples. Examples which have been reduced to practice are stated in the past tense, and examples which are constructively reduced to practice herein are presented in the present tense. Temperatures are given in degrees Fahrenheit unless otherwise specified.

EXAMPLE 1

Samples of used automotive crankcase oil were obtained for use in the process of the present invention. One of the two samples is identified as Used Oil I, the other is identified as Used Oil II. The initial chemical properties of the used oil were measured and are listed below in Table I. Eight aliquots were removed from Used Oil I. Each aliquot or sample was then subjected to the present process. The temperature was varied with each sample: Two of the eight samples were heated to 350° F.; two were heated to 550° F.; two were heated to 650° F.; and two were heated to 850° F. In addition, the volume of 98% $H_2SO_4$ added to each sample was varied. One sample at each temperature contained 5% $H_2SO_4$ and the other sample contained 10% $H_2SO_4$. At intervals of one, two and three days a measurement was taken to determine the percent of acid sludge which had settled. The results are listed in Tables I and II.

TABLE I

| CHARACTERISTICS | USED OIL 1 | USED OIL 2 |
|---|---|---|
| Color | Brownish/Black | Black |
| Odor | burnt with diesel odor | Burnt |
| A.P.I. gravity at 60/60 F, ASTM D287 | 23.2 | 24.3 |
| Viscosity, 100 F, SSU | 275 | 350 |
| Water, ASTM D95 | 0.2% | 1.0% |
| Pentane insoluble ASTM D893 | 2.0% | 3.0% |

TABLE II

| CHARACTERISTICS | CONDITIONS | | | | | | | |
|---|---|---|---|---|---|---|---|---|
| Dehydration/Fractionation Temperature F | 350 | | 550 | | 650 | | 850 | |
| Acid Strength % | 98 | | 98 | | 98 | | 98 | |
| Acid Dosage, % | 5 | 10 | 5 | 10 | 5 | 10 | 5 | 10 |
| % Acid Sludge Settled v. the ff. settling time | | | | | | | | |
| 1 day | 0 | 20 | 10 | 25 | 30 | 50 | 85 | 100 |
| 2 days | 5 | 30 | 15 | 35 | 50 | 60 | 100 | 100 |
| more than 3 days | 5 | 30 | 15 | 40 | 60 | 75 | | |
| Reclaimed Oil: | | | | | | | | |
| Color, ASTM D1500 | — | — | — | — | D8 | 7.5 | 2.5 | 2.5 |
| Viscosity, 100 C, cst, ASTM D445 | — | — | — | — | 7.0 | 7.0 | 7.0 | 7.0 |

As indicated in Table II, after more than three days, only 30% of the acid sludge had settled in the 10% $H_2SO_4$, 350° F. sample. Moreover, only 5% of the 5% $H_2SO_4$, 350° F. sample had settled after three days. In addition, the color of the oil could not be measured, because it was too dark and the viscosity could not be obtained because of the presence of unsettled sludge. However, at 650° F. and 850° F. significant improvements in these properties were observed. For example, when the oil was processed at 850° F., 100% of the acid sludge had settled in just one day for the 10% $H_2SO_4$ sample, and 100% of the 5% $H_2SO_4$ oil had settled after only two days. In addition, the color of the oil was 2.5 and the viscosity at 100° C. was 7.0 centistokes.

EXAMPLE 2

Used Oil II was processed according to the process described in Example 1 regarding Used Oil I. Similar results were obtained for Used Oil II as indicated in Table III.

TABLE III

| CHARACTERISTICS | CONDITIONS | | | | | | | |
|---|---|---|---|---|---|---|---|---|
| Dehydration/Fractionation Temperature F | 350 | | 550 | | 650 | | 850 | |
| Acid Strength % | 98 | | 98 | | 98 | | 98 | |
| Acid Dosage, % | 5 | 10 | 5 | 10 | 5 | 10 | 5 | 10 |
| % Acid Sludge Settled v. the ff. settling time | | | | | | | | |
| 1 day | 0 | 15 | 10 | 20 | 50 | 75 | 100 | 100 |
| 2 days | 5 | 25 | 10 | 30 | 80 | 90 | 100 | 100 |
| more than 3 days | 10 | 30 | 15 | 40 | 80 | 90 | | |
| Reclaimed Oil: | | | | | | | | |
| Color, ASTM D1500 | — | — | — | — | D8 | 7.0 | 2.5 | 2.5 |
| Viscosity, 100 C, cst, ASTM D445 | — | — | — | — | 6.2 | 6.2 | 6.2 | 6.2 |

The following methods (which can be found in Appendices A–E) from the American National Standard Institute and the American Society for Testing and Materials, were used to obtain values set forth in Examples 1 and 2:

1. ANSI/ASTM D 287, Standard Test Method for API GRAVITY OF CRUDE PETROLEUM AND PETROLEUM PRODUCTS (HYDROMETER METHOD), pp. 187–190 (1977).
2. ANSI/ASTM D 95, Standard Test Method for WATER IN PETROLEUM PRODUCTS AND BITUMINOUS MATERIALS BY DISTILLATION, pp. 59–63 (1970, Reapproved 1980).
3. ANSI/ASTM D 893, Standard Test Method for INSOLUBLES IN USED LUBRICATING OILS, pp. 395–401 (1980).
4. ANSI/ASTM D1500, Standard Test Method for ASTM COLOR OF PETROLEUM PRODUCTS (ASTM COLOR SCALE), pp 803–806 (1964, Reapproved 1977).
5. ANSI/ASTM D 445, Standard Test Method for KINEMATIC VISCOSITY OF TRANSPARENT AND OPAQUE LIQUIDS (AND THE CALCULATION OF DYNAMIC VISCOSITY), pp. 243–248 (1979).

What is claimed is:

1. A process for re-refining used oil comprising the steps of:

(1) providing used oil having impurities including carbonaceous materials, metals and other oxidizable components and dispersant additives, (2) heating the oil for whatever interval is necessary to reach a temperature equal to or greater than about 745 degrees Fahrenheit and less than or equal to 1000 degrees Fahrenheit and holding said temperature for an interval effective to negate the ability of any dispersant additives to keep said impurities in solution, (3) cooling the oil to approximately 70–120 degrees Fahrenheit, (4) adding a sufficient amount of oxidizing agent of a type adequate to oxidize at least said carbonaceous materials, metals and other oxidizable components to create acid sludge in solution and of a concentration adequate to cause substantially complete settling of acid sludge from said oil being processed within an interval of less than approximately three days such that the resulting mixture is 20–30% by volume acid sludge with the remainder being acid-sludge-free oil, (5) waiting until substantially all settling of acid sludge occurs, and then separating the acid sludge which has settled out of the mixture of the used oil and the oxidizing agent from the remaining components of the mixture to create a volume of substantially acid-sludge-free oil; and (6) adding a polishing agent adequate at least to substantially neutralize remaining acidity and remove at least some of the remaining particles which color the oil so as to obtain a quantity of re-refined oil which constitutes a yield of approximately 70–80% by volume of the quantity of used oil remaining after the heating of step (2) above.

2. A process for re-refining used oil comprising the steps of:

(1) providing used oil having impurities including carbonaceous materials, metals and other oxidizable components and dispersant additives, (2) heating the oil for whatever interval is necessary to reach a temperature equal to or greater than about 745 degrees Fahrenheit and less than or equal to 1000 degrees Fahrenheit and holding said temperature for an interval effective to negate the ability of any dispersant additives to keep said impurities in solution, (3) cooling the oil to approximately 70–120 degrees Fahrenheit, (4) adding a sufficient amount of oxidizing agent of a type adequate to oxidize at least said carbonaceous materials, metals and other oxidizable components to create acid sludge in solution and of a concentration adequate to cause substantially complete settling of acid sludge from said oil being processed within an interval of less than approximately three days such that the resulting mixture is 20–30% by volume acid sludge with the remainder being acid-sludge-free oil, (5) waiting until substantially all settling of acid sludge occurs, and then separating the acid sludge which has settled out of the mixture of the used oil and the oxidizing agent from the remaining components of the mixture to create a volume of substantially acid-sludge-free oil; and (6) adding a polishing agent adequate at least to substantially neutralize remaining acidity and remove at least some of the remaining particles which color the oil so as to obtain a quantity of re-refined oil which constitutes a yield of approximately 70–80% by volume of the quantity of used oil remaining after the heating of step (2) above, and wherein the step of adding an oxidizing agent comprises the step of adding sulfuric acid having a concentration adequately high and having a volume sufficient to cause complete sedimentation of acid sludge within about 72 hours or less.

3. The process of claim 1 wherein said heating step comprises heating the oil to a temperature in the range from a temperature equal to or greater than about 745° F. to some temperature preferably less than or equal to about 900° F., and wherein the step of adding an oxidizing agent comprises the step of adding sulfuric acid having a concentration of from approximately 80–98 weight %, and adding a volume of sulfuric acid generally comprising 3–15% and, preferably, 5–10% by volume of the volume of said used oil, and wherein the step of adding a polishing agent comprises the step of adding an agent having large pores and large surface area per particle selected from the group consisting of clay, bleaching earth, activated carbon or bauxite to absorb oxidized particles and particles that color the oil and deodorize, lighten the color and neutralize the acidic nature of the re-refined oil.

4. The process of claim 1 further comprising the steps of applying a vacuum to the heated oil contained in a closed chamber and steam sparging the oil during the heating interval, and wherein said heating step comprises heating the oil to a temperature in the range from a temperature equal to or greater than about 745° F. to some temperature preferably less than or equal to about 850° F., and wherein the step of adding an oxidizing agent comprises the step of adding sulfuric acid having a concentration of from approximately 80–98 weight %, and adding a volume of sulfuric acid generally comprising 3–15% and, preferably, 5–10% by volume of the volume of said used oil, and wherein the step of adding a polishing agent comprises the step of adding a sufficient amount of polishing agent having large pores and large surface area per particle so as to absorb oxidized particles and particles that color the oil and deodorize and neutralize the acidic nature of the re-refined oil and lighten the color thereof so as to be from 2.0–5.0, and, preferably, from 2.0–3.0 measured according to the color scale of the American Society for Testing and Materials, method D1500.

5. The process of claim 1 further comprising the step of pumping inert gas into the area above the heated oil in a vented chamber during heating of the oil so as to prevent the possibility of explosion from outgassing of flammable compounds during the heating process.

6. The process of claim 1 further comprising the step of pumping steam through the oil being re-refined during the step of heating of said oil.

7. The process of claim 1 further comprising the step of pumping inert gas into the area above the heated oil in a vented chamber during heating of the oil so as to reduce the possibility of explosion from outgassing of flammable compounds during the heating process, and further comprising the step of pumping steam through the oil being re-refined during the step of heating of said oil to help heat the oil and reduce the possibility of explosion during said heating step.

8. The process of claim 1 further comprising the step of applying vacuum to the oil being heated.

9. The process of claim 6 wherein the polishing agent is activated clay.

10. The process of claim 1 wherein the oxidizing agent is sulfuric acid having a concentration from 80–98 weight percent and the quantity thereof added to said heat treated used oil comprises 3–15% by volume of the volume of said used oil, and wherein the step of adding a polishing agent comprises the step of adding a amount of activated clay to comprise 3–15% by weight of the overall solution, and wherein said step of heating further includes the step of bubbling steam through said oil during the heating process to remove light ends.

11. The process of claim 10 wherein the step of separating said acid-sludge-free oil comprises the step of pumping out said acid sludge from the bottom of the vessel containing the oil being re-refined.

12. The process of claim 6 further comprising the step of agitating the mixture after addition of said oxidizing agent.

13. The process of claim 1 further comprising the step of agitating the cooled oil during or after the addition of oxidizing agent and allowing the oxidized impurities to settle.

14. An improved process for re-refining used oil, comprising:

providing used oil having impurities therein;

heating the used oil to a temperature above about 745 degrees Fahrenheit and usually less than or equal to approximately 850 degrees Fahrenheit;

cooling the oil to a temperature in the range from 70–120 degrees Fahrenheit;

adding an oxidizing agent of a type adequate to oxidize at least carbonaceous materials, metals and other oxidizable components in the used oil so as to cause oxidation of impurities and create acid sludge in solution with the concentration and volume of said oxidizing agent being sufficient to cause settling of substantially all said acid sludge within less than approximately 2 days;

waiting for a period of less than or equal to approximately one to two days for the acid sludge created by addition of said oxidizing agent to settle to the bottom of the vessel containing the used oil being re-refined;

separating oil which is free of acid sludge from said acid sludge to create a quantity of acid-sludge-free oil;

adding a polishing agent to said acid-sludge-free oil, said polishing agent being adequate at least to substantially neutralize remaining acidity in said acid-sludge-free oil and to substantially remove the remaining particles which color the oil.

15. The process of claim 14 wherein said step of adding polishing agent comprises adding sufficient polishing agent having large pores and large surface area sufficient to absorb oxidized particles and particles that color said acid-sludge-free oil such that such acid-sludge-free oil has a color from 2.0–5.0 and preferably 2.0– 3.0 on the color scale of the American Society for Testing and Materials measured according to method D1500.

16. The process of claim 14 wherein said step of heating said oil comprises heating said oil to a temperature of approximately 850° F. for an interval sufficient to negate the ability of any dispersant additives in said used oil to hold impurities in solution, and then, after cooling said oil to approximately room temperature, adding oxidizing agent, and wherein the step of adding oxidizing agent comprises the step of adding 5–10% by volume of the volume of said used oil of sulfuric acid having a concentration from 98 weight percent so as to result in substantially complete settling out of acid sludge in less than or equal to approximately 24 hours.

17. The process of claim 16 further comprising bubbling of steam through said oil during the heating step.

18. The process of claim 17 further comprising heating the oil in a closed chamber and pumping inert gas into the space in said chamber above said oil to lower the possibility of explosion by reducing the oxygen content in the atmosphere above the heated oil containing volatile, light molecular weight hydrocarbons which boil out of said used oil during said heating step.

19. The process of claim 14 further comprising the step of agitation of said oil after addition of said oxidizing agent.

20. The process of claim 17 further comprising applying vacuum to the used oil being heated.

* * * * *